US008033784B2

(12) United States Patent
Bachofner et al.

(10) Patent No.: US 8,033,784 B2
(45) Date of Patent: Oct. 11, 2011

(54) COMPRESSOR ROTOR

(75) Inventors: René Bachofner, Untersiggenthal (CH); Wolfgang Kappis, Fislisbach (CH); Kurt Rubischon, Lengnau (CH)

(73) Assignee: ALSTOM Technology Ltd., Baden (CH)

( * ) Notice: Subject to any disclaimer, the term of this patent is extended or adjusted under 35 U.S.C. 154(b) by 235 days.

(21) Appl. No.: 11/382,292

(22) Filed: May 9, 2006

(65) Prior Publication Data

US 2006/0228210 A1 Oct. 12, 2006

Related U.S. Application Data

(63) Continuation of application No. PCT/EP2004/052993, filed on Nov. 17, 2004.

(30) Foreign Application Priority Data

Dec. 4, 2003 (DE) ..... 103 56 586

(51) Int. Cl.
*F01D 25/28* (2006.01)
*F28F 7/00* (2006.01)

(52) U.S. Cl. ..... 415/135; 415/139

(58) Field of Classification Search ..... 415/135, 415/136, 138, 139, 174.4, 173.1
See application file for complete search history.

(56) References Cited

U.S. PATENT DOCUMENTS

| | | | | |
|---|---|---|---|---|
| 2,772,854 A | | 12/1956 | Anxionnaz | |
| 3,088,708 A | * | 5/1963 | Feinberg | 416/215 |
| 3,143,383 A | | 8/1964 | Bamberger et al. | |
| 4,867,639 A | * | 9/1989 | Strangman | 415/173.4 |
| 5,232,336 A | | 8/1993 | Baer et al. | |
| 5,308,227 A | | 5/1994 | Gros et al. | |
| 5,630,702 A | | 5/1997 | Marmilic et al. | |
| 5,842,831 A | * | 12/1998 | Galke et al. | 416/95 |
| 6,406,256 B1 | * | 6/2002 | Marx | 415/138 |
| 6,558,118 B1 | | 5/2003 | Brisson et al. | |

FOREIGN PATENT DOCUMENTS

| | | |
|---|---|---|
| DE | 19615549 | 10/1997 |
| DE | 19619438 | 11/1997 |
| DE | 19808740 | 9/1999 |
| EP | 0709548 | 5/1996 |
| EP | 1076157 | 2/2001 |
| WO | W02005/054634 | 6/2005 |

OTHER PUBLICATIONS

Search Report for German Patent App. No. 103 56 586.8 (Jul. 28, 2004).
Search Report for PCT App. No. PCT/EP2004/052993 (Mar. 17, 2005).

* cited by examiner

*Primary Examiner* — Edward Look
*Assistant Examiner* — Dwayne J White
(74) *Attorney, Agent, or Firm* — Cermak Nakajima LLP; Adam J. Cermak

(57) ABSTRACT

A compressor has a rotor (13), which rotor (13) has a number of rows of rotor blades (14, 14') which are at a distance from one another, one behind the other in the axial direction, with a number of thermal barrier segments (10), which are detachably attached to the rotor (13) and are mounted such that they can move in the circumferential direction, being arranged one behind the other in the circumferential direction on the circumference of the rotor (13), and with securing devices (15) being provided on the thermal barrier segments (10), which secure the thermal barrier segments (10) against being moved in the circumferential direction. In the case of such a rotor (13), production and assembly are simplified in that only some of the thermal barrier segments (10) are equipped with the securing devices (15).

7 Claims, 3 Drawing Sheets

COMPRESSOR ROTOR

This application is a Continuation of, and claims priority under 35 U.S.C. §120 to, International application number PCT/EP2004/052993, filed 17 Nov. 2004, and claims priority under 35 U.S.C. §119 to German application number 103 56 586.8, filed 4 Dec. 2003, the entireties of both of which are incorporated by reference herein.

BACKGROUND OF THE INVENTION

1. Field of the Invention

The present invention relates to the field of turbomachines, and in particular to a compressor having a rotor.

2. Brief Description of the Related Art

High-pressure compressors, as are used in particular for compression of the combustion air in gas turbines, include a multistage blade system, which includes rotor blades and stator blades arranged alternately in the axial direction. The rotor blades are mounted on the rotor, which is mounted such that it can rotate. The stator blades are arranged between adjacent rotor blade rims on the inner housing of the compressor.

The air which flows through the annular channel in the compressor formed between the rotor and the inner housing and which is compressed in the process is heated as a result of being compressed. In order to protect the rotor and the inner housing against being thermally overloaded by the heated air, thermal barrier elements are frequently arranged between adjacent rotor blade and stator blade rims, and form a circumferential protective ring (see, for example, DE-A 1-198 08 740). Since the thermal barrier segments are in each case opposite the blade tips of the rotor blades and stator blades, and abut against them, they are a significant factor in the setting of the blade clearance. In order to prevent direct contact between the blade tips and the thermal barrier segments, cutting tools are arranged between the thermal barrier segments, which project by a specific amount beyond the thermal barrier segments and at the same time prevent the thermal barrier segments from being moved in the circumferential direction. However, a rotor design such as this is highly complex to manufacture and assemble.

One known embodiment of the thermal barrier segments on the rotor side, that is to say those which are opposite the stator blades, is described in DE-A-1-196 15 549, and is also illustrated in FIG. 1 of the present application. The known thermal barrier segments 10 are in the form of shell-shaped circular ring segments which have a smooth outer surface 11, with two segment feet 12, which extend parallel in the circumferential direction, and have a hook-shaped cross section, being integrally formed on its lower face. In order to secure the thermal barrier segments 10, a circumferential groove with two hooks which extend over the entire circumference is provided between adjacent rotor blade rims in the rotor, behind which hooks the segment feet of the thermal barrier segments are hooked in. Each of the thermal barrier segments is secured against movement in the circumferential direction by means of a securing pin (FIG. 3 and claim 4 of DE-A-1-196 15 549). In this case as well, the method in which each thermal barrier segment is secured in the circumferential direction involves considerable complexity, because the corresponding holes must be incorporated in the rotor and in the thermal barrier segments, and the securing pins must be installed. Furthermore, in this case, no precautions are taken to set a specific clearance between the thermal barrier segments and the blade tips.

SUMMARY OF THE INVENTION

One aspect of the present invention includes providing a compressor with a rotor which avoids the disadvantages of known solutions and is distinguished by simplifying production and assembly.

Another aspect of the present invention includes not securing every thermal barrier segment against being moved in the circumferential direction, but to equip only a subset of selected segments with corresponding securing means. This results in a considerable reduction in the complexity both for production and for assembly. Those thermal barrier segments which are not equipped with securing means are in this case also secured by the thermal barrier segments which are equipped with securing means.

This type of securing method is particularly advantageous if, according to one preferred refinement of the invention, when seen in the circumferential direction, every alternate thermal barrier segment is equipped with the securing means, because this makes it possible to achieve maximum security with minimal complexity.

In particular, the thermal barrier segments have segment feet with a hook-shaped cross section, by means of which they are hooked in behind circumferential rotor hooks which are integrally formed on the rotor, and the securing means include a securing pin, which extends in the axial direction through the segment feet and rotor hooks, with the securing pin in each case being arranged, in particular, in the center of the thermal barrier segment, when seen in the circumferential direction.

If stator blades whose blade tips end at an outer surface of the thermal barrier segments are arranged in the area of the thermal barrier segments, it is particularly advantageous with this type of security for the outer surface of the thermal barrier segments to be provided with an abrasion layer, which results in material being worn away from the blade tips when the blade tips of the stator blades slide on the outer surfaces of the thermal barrier segments.

BRIEF DESCRIPTION OF THE DRAWINGS

The invention will be explained in more detail in the following text with reference to exemplary embodiments and in conjunction with the drawing, in which.

DETAILED DESCRIPTION OF EXEMPLARY EMBODIMENTS

Figure 1:
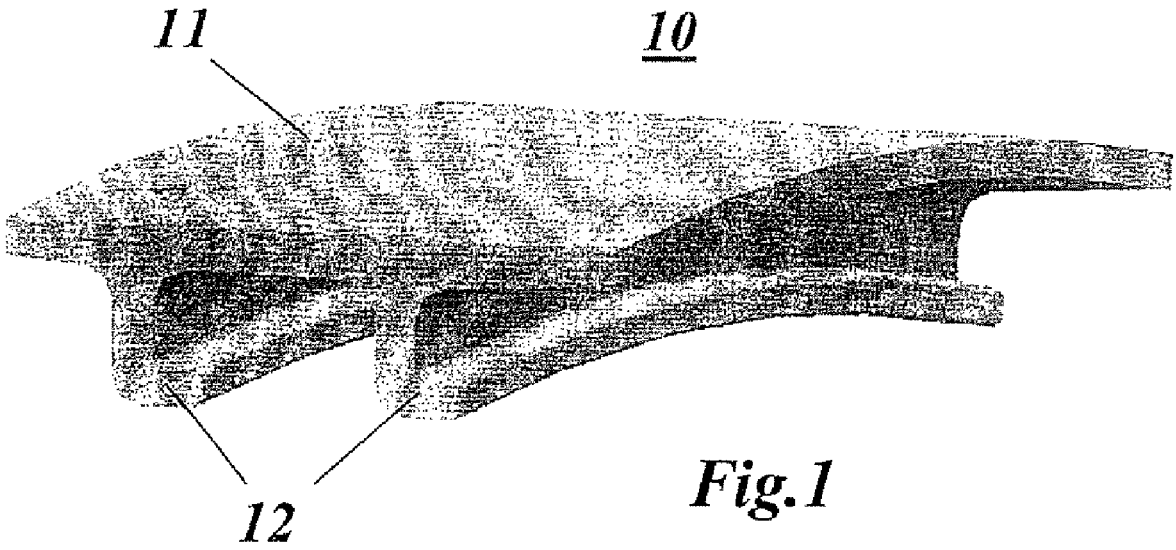
Fig.1 (Prior Art)
FIG. 1 shows a perspective side view of a thermal barrier segment which is known per se, as is used for the purposes of the invention.
Figure 2:
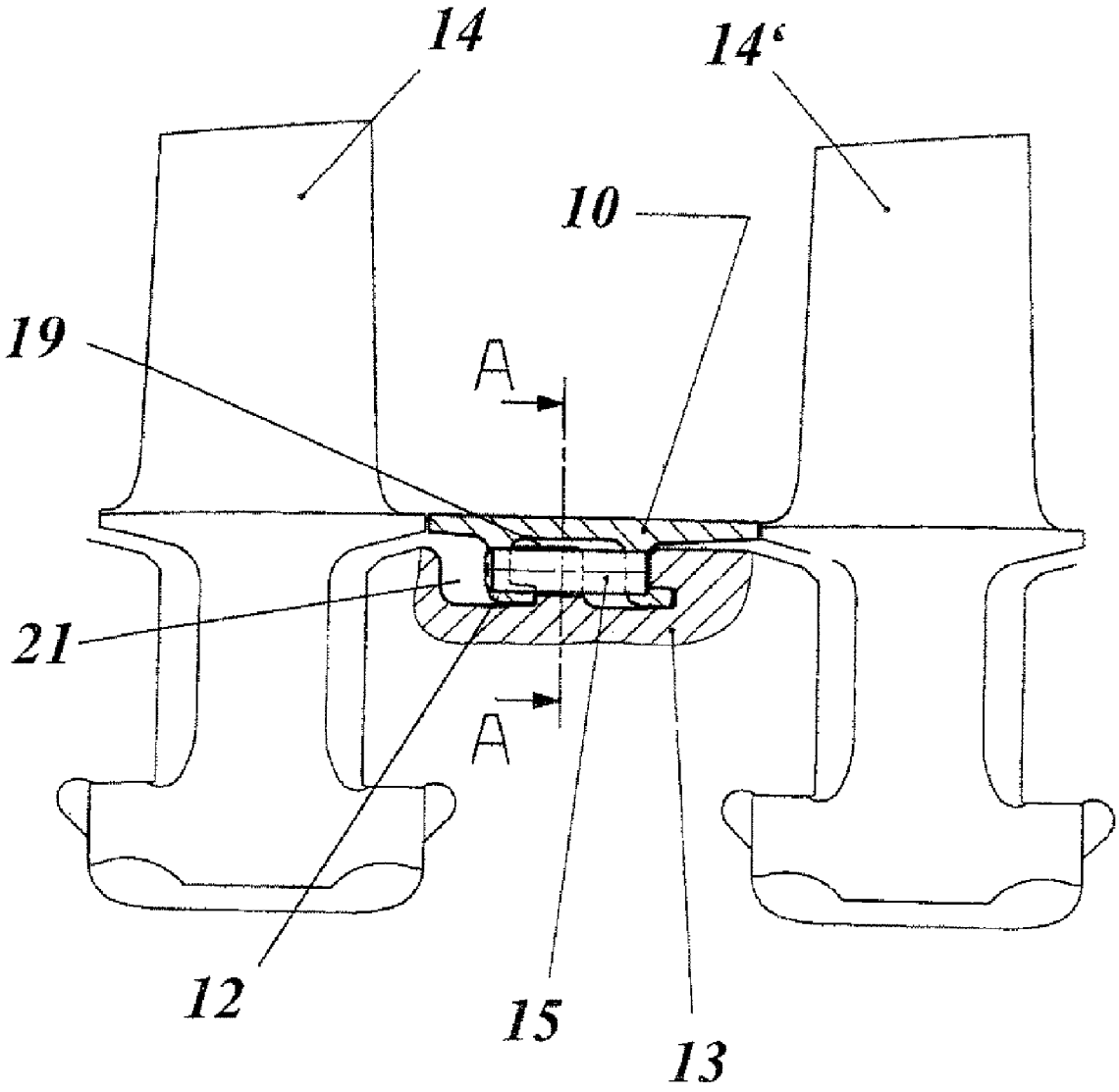
FIG. 2 shows a partially sectioned view of the arrangement of the thermal segments between adjacent rows of stator blades with securing means according to one exemplary embodiment of the invention.

One preferred exemplary embodiment of the invention is based on a thermal barrier segment 10 of the type illustrated in FIG. 1, which is attached by means of the segment feet 12 to the rotor between two rotor blade rows, and whose outer surface 11 is opposite the blade tips of the stator blades (16 in FIG. 4) which are arranged between the rows of rotor blades. FIG. 2 shows the arrangement of the thermal barrier segments 10 on the rotor 13 between the rotor blades 14, 14' of adjacent rows of rotor blades. A circumferential groove 21 is incorporated in the rotor 13 for this purpose, in which two rotor hooks 19 run parallel in the circumferential direction (see also FIG. 4). The segment feet 12 of the thermal barrier segments 10 are hooked into these rotor hooks 19, so that the outer surface 11 of the thermal barrier segments is adjacent to the platforms of the rotor blades 14, 14'. An axially oriented securing pin 15 in the form of a circular-cylindrical bolt is provided in order to secure the thermal barrier segment 10 (which is illustrated in FIG. 2), and is passed through appropriate holes in the segment feet 12 and in one of the rotor hooks 19. The securing pin 15 is in this case preferably arranged in the center of the thermal barrier segment 10 when seen in the circumferential direction.

Figure 3:
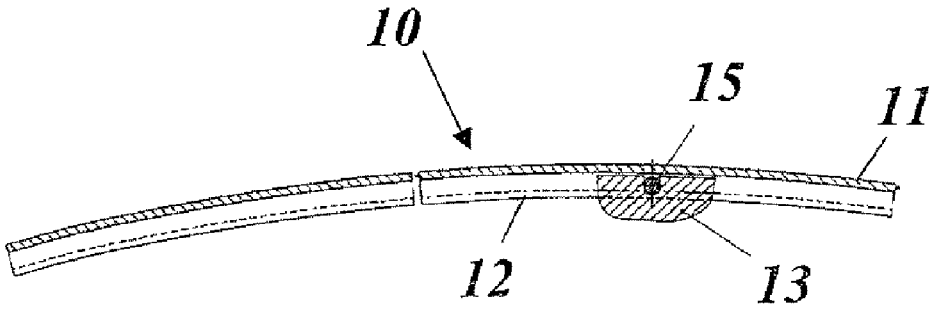
FIG. 3 shows the section along the plane A-A from FIG. 2.

The section (which is illustrated in FIG. 3) on the plane A-A in FIG. 2 shows that, of two adjacent thermal barrier segments, only one (that on the right in FIG. 3) thermal barrier segment is secured by means of a securing pin 15. All of the thermal barrier segments which are arranged between the two rows of rotor blades 14 and 14' together form a segmented thermal barrier, in which every alternate segment is secured by means of a securing pin 15 against "migration" over the circumference.

Figure 4:
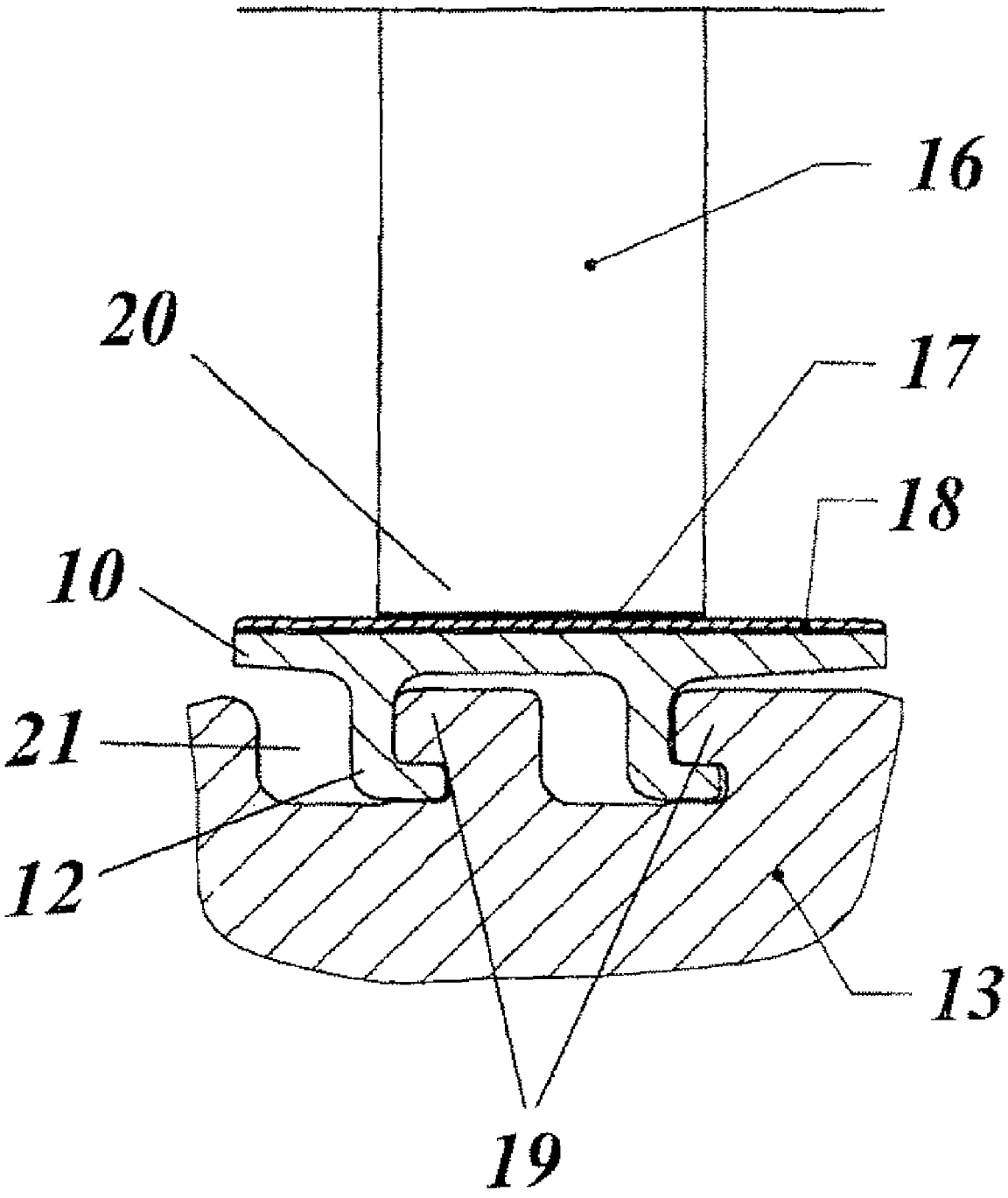
FIG. 4 shows a view, comparable to that in FIG. 2, of a thermal barrier segment provided with an abrasion layer, according to the invention.

In order to make it possible to set the optimum clearance between the outer surface 11 of the thermal barrier segments 10 and the blade tips of the abutting stator blades for the thermal barrier segments which are secured in this way, the outer surface is provided with an abrasion layer 18, as shown in FIG. 4. The abrasion layer 18 is composed of a material which is harder than the material of the abutting stator blades 16. This means that the rotor blades 16 which run over the abrasion layer 18 are worn away as they pass over the thermal barrier segment 10, in which material is worn away in an abrasion area 17 on the blade tip 20. This prevents the surface of the thermal barrier segment 10 from being heated by friction all the time.

LIST OF REFERENCE SYMBOLS

10 Thermal barrier segment
11 Outer surface (thermal barrier segment)
12 Segment foot
13 Rotor
14 Rotor blade
15 Securing pin
16 Stator blade
17 Abrasion area
18 Abrasion layer
19 Rotor hook
20 Blade tip (stator blade)
21 Circumferential groove While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A compressor comprising:
a rotor having an axis and a number of rows of rotor blades positioned axially at a distance from one another;
a number of thermal barrier segments detachably attached to the rotor and movably mounted such that they can move in the circumferential direction, the thermal barrier segments being arranged one behind the other in the circumferential direction on the circumference of the rotor;
securing means on the thermal barrier segments for securing the thermal barrier segments against being moved in the circumferential direction;
wherein circumferentially only every other thermal barrier segment comprises the securing means.

2. The compressor as claimed in claim 1, wherein the securing means is circumferentially arranged in the center of the thermal barrier segment.

3. The compressor as claimed in claim 1, further comprising:
stator blades arranged in the area of the thermal barrier segments, the stator blades having blade tips which end at an outer surface of the thermal barrier segments; and
an abrasion layer on the outer surface of the thermal barrier segments configured and arranged to wear away material on the stator blade tips when the stator blade tips slide on the outer surfaces of the thermal barrier segments.

4. A compressor comprising:
a rotor having an axis and a number of rows of rotor blades positioned axially at a distance from one another;
a number of thermal barrier segments detachably attached to the rotor and movably mounted such that they can move in the circumferential direction, the thermal barrier segments being arranged one behind the other in the circumferential direction on the circumference of the rotor;
circumferential rotor hooks integrally formed on the rotor;
wherein the thermal barrier segments comprise segment feet with a hook-shaped cross section by which the thermal barrier segments are hooked in behind the circumferential rotor hooks;
securing means on the thermal barrier segments for securing the thermal barrier segments against being moved in the circumferential direction;
wherein circumferentially only every other thermal barrier segment comprises the securing means; and
wherein the securing means comprises at least one securing pin axially extending through the segment feet and at least one of the rotor hooks.

5. The compressor as claimed in claim 4, wherein the at least one securing pin is circumferentially arranged in the center of the thermal barrier segment.

6. The compressor as claimed in claim 4, further comprising:
stator blades arranged in the area of the thermal barrier segments, the stator blades having blade tips which end at an outer surface of the thermal barrier segments; and
an abrasion layer on the outer surface of the thermal barrier segments configured and arranged to wear away material on the stator blade tips when the stator blade tips slide on the outer surface of the thermal barrier segments.

7. The compressor as claimed in claim 4, wherein the at least one securing pin axially extends through two adjacent segment feet and a rotor hook.

* * * * *